US005438723A

United States Patent [19]

Carroll

[11] Patent Number: 5,438,723

[45] Date of Patent: * Aug. 8, 1995

[54] COLLAPSIBLE BED AND PANEL HINGE

[75] Inventor: Timothy Carroll, London, Canada

[73] Assignee: Carroll Equipment Sales Corporation, London, Canada

[ * ] Notice: The portion of the term of this patent subsequent to Nov. 2, 2010 has been disclaimed.

[21] Appl. No.: 38,201

[22] Filed: Mar. 26, 1993

Related U.S. Application Data

[63] Continuation-in-part of Ser. No. 903,409, Jun. 24, 1992, Pat. No. 5,257,428.

[51] Int. Cl.[6] ..... A47C 19/00

[52] U.S. Cl. ..... 5/620; 5/618; 5/201; 5/313.1; 5/611; 16/267

[58] Field of Search ..... 16/267, 271, 386; 5/600, 611, 618, 620, 201, 249, 285, 286, 287, 613, 313.1, 310

[56] References Cited

U.S. PATENT DOCUMENTS

| | | | |
|---|---|---|---|
| 746,223 | 12/1903 | Windom | 5/620 |
| 2,611,907 | 9/1952 | Clerc . | |
| 2,631,300 | 3/1953 | Murray . | |
| 3,138,805 | 6/1964 | Piazzo . | |
| 3,456,289 | 7/1969 | Goodman . | |
| 3,965,500 | 6/1976 | Stein, Jr. . | |
| 4,084,214 | 4/1978 | Eppich | 16/267 |
| 4,103,170 | 7/1978 | Spradlin | 5/620 |
| 4,202,062 | 5/1980 | Marcyan . | |
| 4,413,366 | 11/1983 | Whitehead . | |
| 4,435,862 | 3/1984 | King . | |
| 4,457,502 | 7/1984 | Beach | 5/620 |
| 4,598,889 | 7/1986 | Remington | 16/267 |
| 4,885,160 | 8/1987 | Rizzardo . | |
| 4,970,737 | 11/1990 | Sagel . | |
| 5,070,577 | 12/1991 | Bonneville | 16/267 |
| 5,095,562 | 3/1992 | Alexander . | |

FOREIGN PATENT DOCUMENTS

| | | | |
|---|---|---|---|
| 1015210 | 3/1950 | France | 16/637 |
| 921562 | 4/1982 | U.S.S.R. . | |

*Primary Examiner*—Flemming Saether

*Attorney, Agent, or Firm*—Arne I. Fors; Jeffrey T. Imai

[57] ABSTRACT

A hospital bed, particulary suitable for home use comprises a plurality of sections which can be releasably connected together, and can be assembled for delivery and storage with head and foot sections, and head and foot boards stacked on a seat section. When thus assembled the bed can be put into a box and for ease of movement wheels project through the bottom of the box. The various sections and parts are releasably connected by pairs of brackets which clip together, the brackets held together by a clip which prevents disengagement. Power means are provided for raising the head section panel and the foot section panel. The bed has fixed legs which are provided with wheels. Movable legs can also be provided, extendable and retractable. When the movable legs are extended the fixed legs are raised, the wheels clear the floor. Head, foot and seat panels are joined together for articulation by means of a novel hinge.

20 Claims, 17 Drawing Sheets

FIG. 14
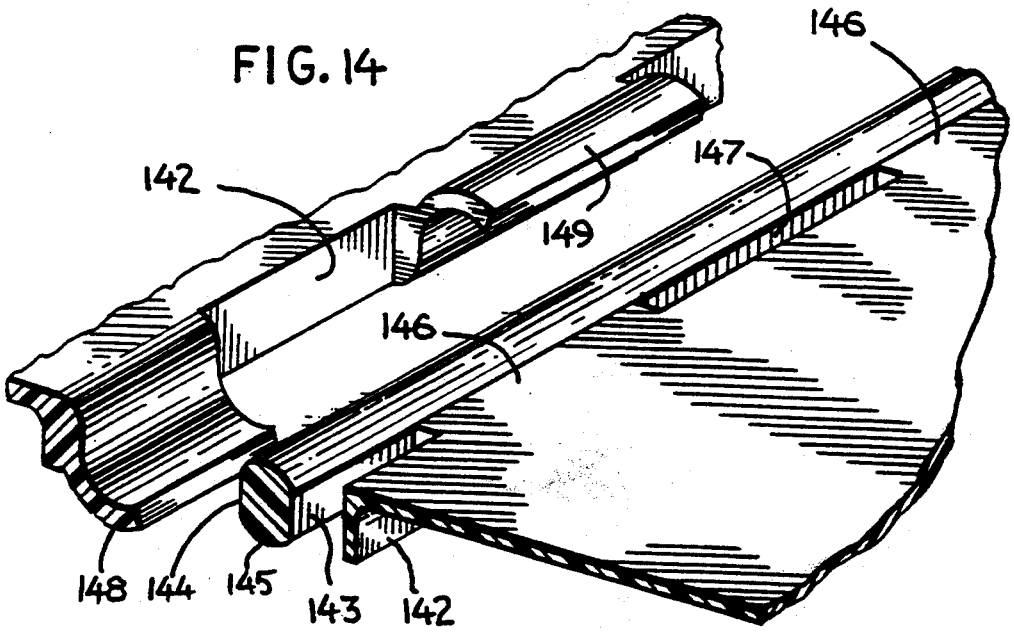
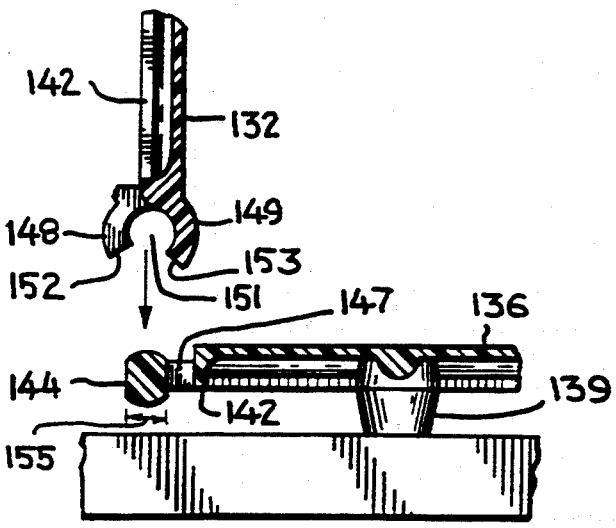
FIG. 15
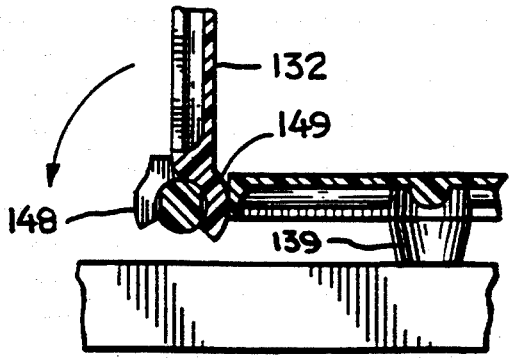
FIG. 16

COLLAPSIBLE BED AND PANEL HINGE

BACKGROUND OF THE INVENTION

This application is a continuation-in-part of application Ser. No. 07/903,409 filed Jun. 24, 1992 now issued as Pat. No. 5,257,428 on Nov. 2, 1993.

This invention relates to hospital beds, and is particularly concerned with a bed which is convenient and suitable for home use, but with all the features of a more conventional hospital bed.

Hospital beds usually have the facility of elevating the head end of the mattress deck and also the knee/foot end. Such beds are also usually mobile in that wheels are provided, with a brake system to prevent movement of the bed when desired.

Such beds are usually of unitary form and are therefore at the least very inconvenient for use in a home as they are difficult to deliver and move into a room.

While it has been proposed to divide a bed into two parts or members, each part is still fairly bulky, with a mattress deck part, legs and head or foot board.

SUMMARY OF THE INVENTION

The present invention provides a bed which is composed of several parts which can be easily assembled together to form a rigid bed, and which can be packaged, in its disassembled form, into a box which is easily transported. The box is of a size that is readily conveyed into a house, into any desired room. Wheels for the bed can be positioned at particular positions on the packaged bed, to project through the bottom of the box, for mobility. These wheels are afterwards repositioned on the bed for providing mobility of the bed.

The head end and the knee/foot end can be raised and lowered, electrically, and the wheels can be raised relative to the floor, to provide stability and prevent unwanted movement of the bed.

Broadly a bed in accordance with the present invention comprises a head section, a foot section and a seat section, with means for connecting the head and foot sections to the seat section; a set of fixed support legs; wheels mounted on the bottom ends of the fixed legs; means for raising and lowering a mattress at said head section and said foot section. A head board and a foot board attached to the opposite ends of the bed. A further set of legs, extendable and retractable, can be provided, with means for extending and retracting the legs.

BRIEF DESCRIPTION OF THE DRAWINGS

The invention will be readily understood by the following description of embodiments, by way of example, in conjunction with the accompanying drawings in which:

FIG. 14 is a perspective view, partly cut away, of the hinge mechanism of the invention;

FIG. 15 is a longitudinal section of the hinge mechanism shown in FIG. 14 before assembly;

FIG. 16 is a longitudinal section of the hinge mechanism shown in FIG. 15 after partial assembly;

DESCRIPTION OF THE PREFERRED EMBODIMENT

Figure 1:
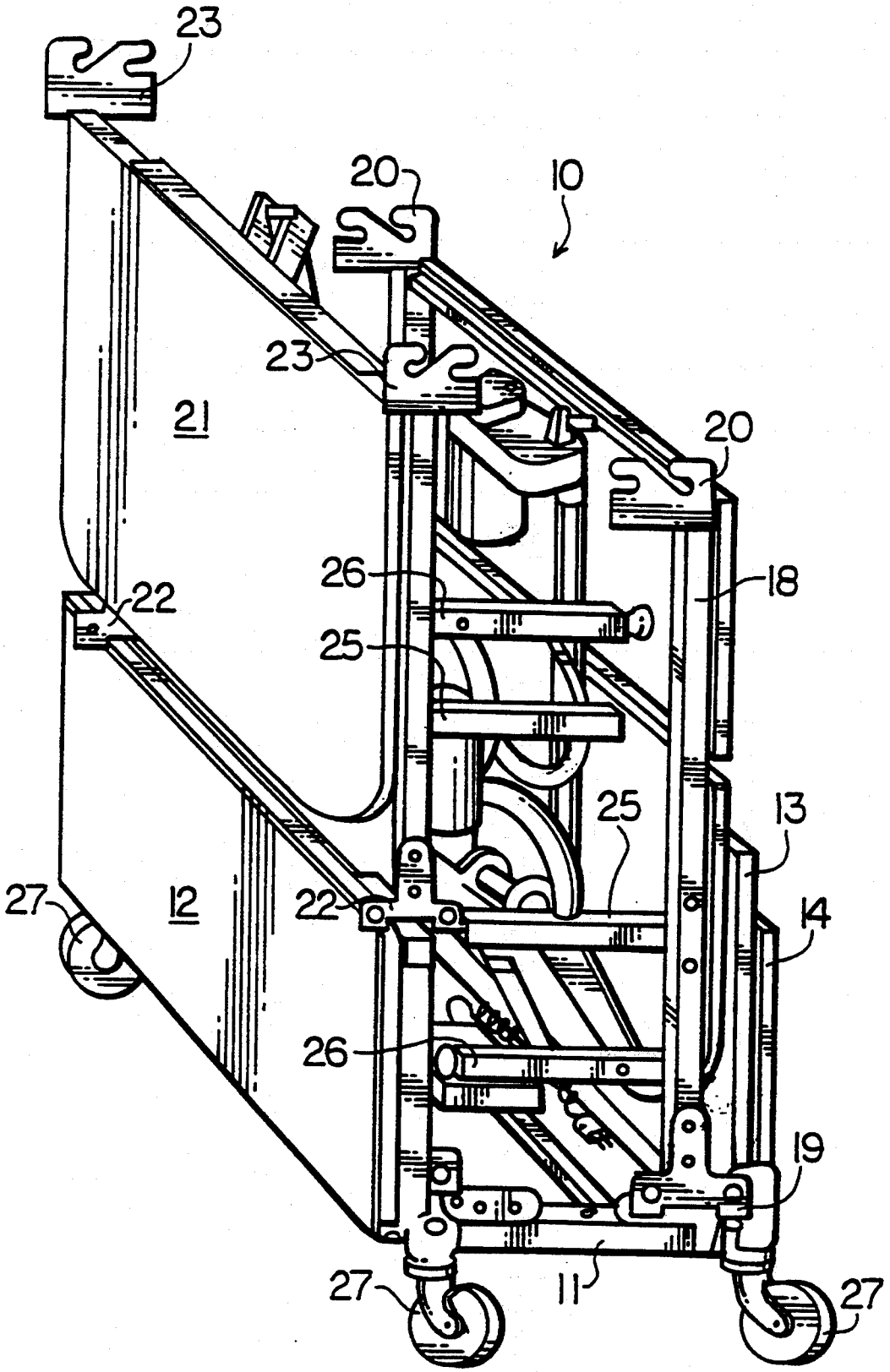
FIG. 1 is a perspective view of a bed in accordance with the present invention, in a packaged condition, but without the box.

As illustrated in FIG. 1, a packed bed, indicated generally at 10, comprises a seat section 11 having a foot board 12 mounted on one side and a head board 13 mounted on the other side. The foot board and head board are mounted on the seat section by pairs of brackets 15 and 16, seen more clearly in FIG. 4. These brackets, after the packaged bed is unpacked, are used as connection means for assembly of the bed. The seat board rests on top of the other pieces.

A foot section 18 rests, in an upright position, on the seat section, having brackets 19 at one end and further brackets 20 at the other end. A head section 21 rests on the upper edge of the foot board 12, having brackets 22 at one end and further brackets 23 at the other end. The head and foot sections carry fixed legs 25 and movable legs 26. Also the various powered mechanisms for raising and lowering the head and foot sections and for extending and retracting the movable legs are mounted on the head and foot sections, being seen more clearly in FIGS. 2 and 3.

For ease in moving the packaged bed, wheels 27 are mounted at each corner of the seat support section into the head and foot board supports 15, the wheels being removed on unpacking and reused as bed wheels. As previously stated, the wheels 27 can project through the bottom of a box in which the bed is packaged.

Figure 2:
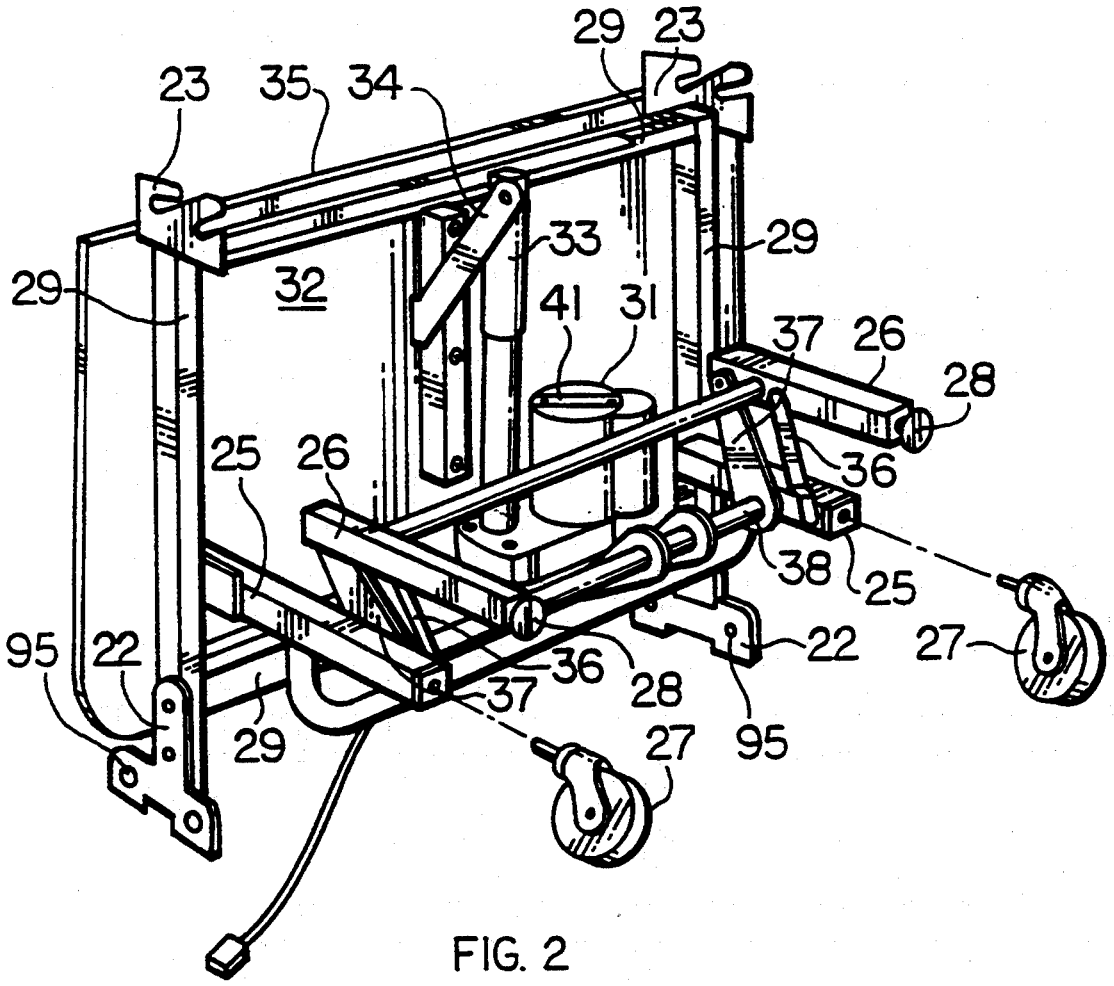
FIG. 2 is a perspective view on the underside of the head section, as unpacked.

FIG. 2 illustrates the head section 21 removed from the packaged bed. Gliders 28, or similar members, are mounted on the lower ends of the movable legs 26 and two of the wheels 27 are mounted on the fixed legs 25. The fixed legs are mounted on a frame 29. An electric motor 31 is mounted on the head section frame, driving a linear jack 33 which raises and lowers the head section board, 32 via arms 34, the board pivoting at its inner edge 35. The brackets 22 are mounted at each head end of the head section and the brackets 23 mounted on each inner end on the frame 29 on each side.

The moveable legs 26 are mounted on the fixed legs 25 by arms 36, each pivotally attached at one end to a fixed leg and pivotally attached at the other end to a movable leg. The movable legs 26 are also mounted on the fixed legs by levers 37. The levers 37 are each pivotally attached at one end to a movable leg and at the other end are unitary with and rotatable with a shaft 38 extending between and rotatably mounted at each end in a fixed leg. The shaft 38 is rotated by further levers 40, as described later. The movable legs are interconnected by a shaft or rod 41.

Figure 3:
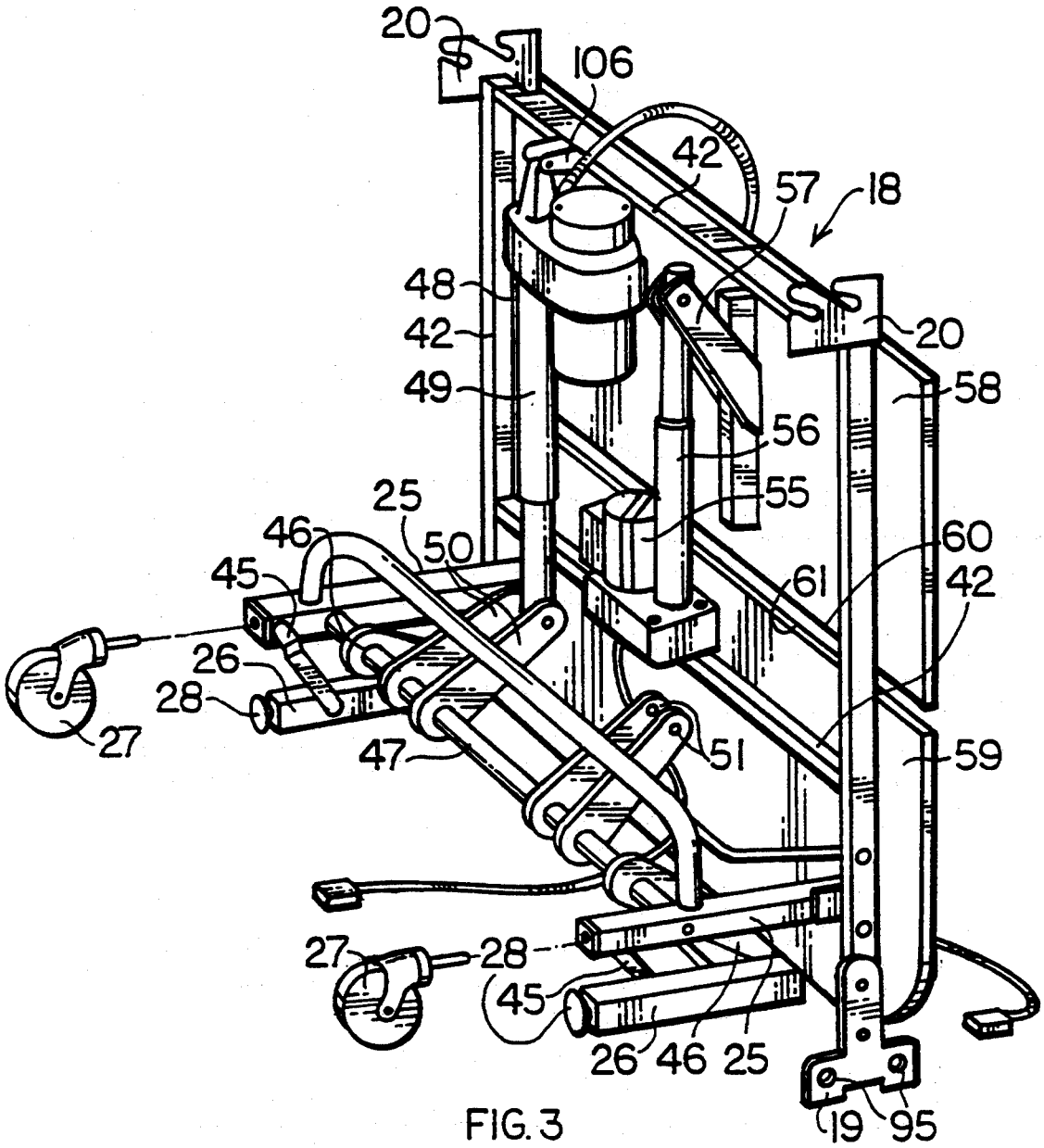
FIG. 3 perspective view on the underside of the foot section as unpacked.

FIG. 3 illustrates the foot section 18 removed from the packaged bed. Gliders 28, or similar, are mounted on the lower ends of the movable legs 26, and two of the wheels 27 are mounted on the fixed legs 25. The fixed legs 25 are mounted on the frame 42. The movable legs 26 are mounted on the fixed legs 25 by arms 45 pivotally attached at one end to a fixed leg and pivotally attached at the other end to a movable leg. The movable legs 26 are also mounted on the fixed legs by levers 46. The levers 46 are each pivotally attached at one end to a movable leg and at the other end are unitary with and rotatable with a shaft 47 extending between and rotatably mounted at each end in a fixed leg. The brackets 19 are mounted at each foot end of the foot section and the brackets 20 are mounted at each inner end, on the frame 42, on each side.

An electric motor 48 is mounted on the foot section frame and drives one end of a linear jack 49. The jack 49 is pivotally attached at its other end to levers 50 fixedly mounted on shaft 47. Actuation of the motor and jack moves the levers 50, rotating shaft 47. This in turn moves the levers 46 to extend and retract the legs 26, depending upon the direction of rotation of the motor 48. Also mounted on the shaft 47 are further levers 51. These are connected to the levers 40, FIG. 2, described later in conjunction with FIG. 8.

Figure 10:
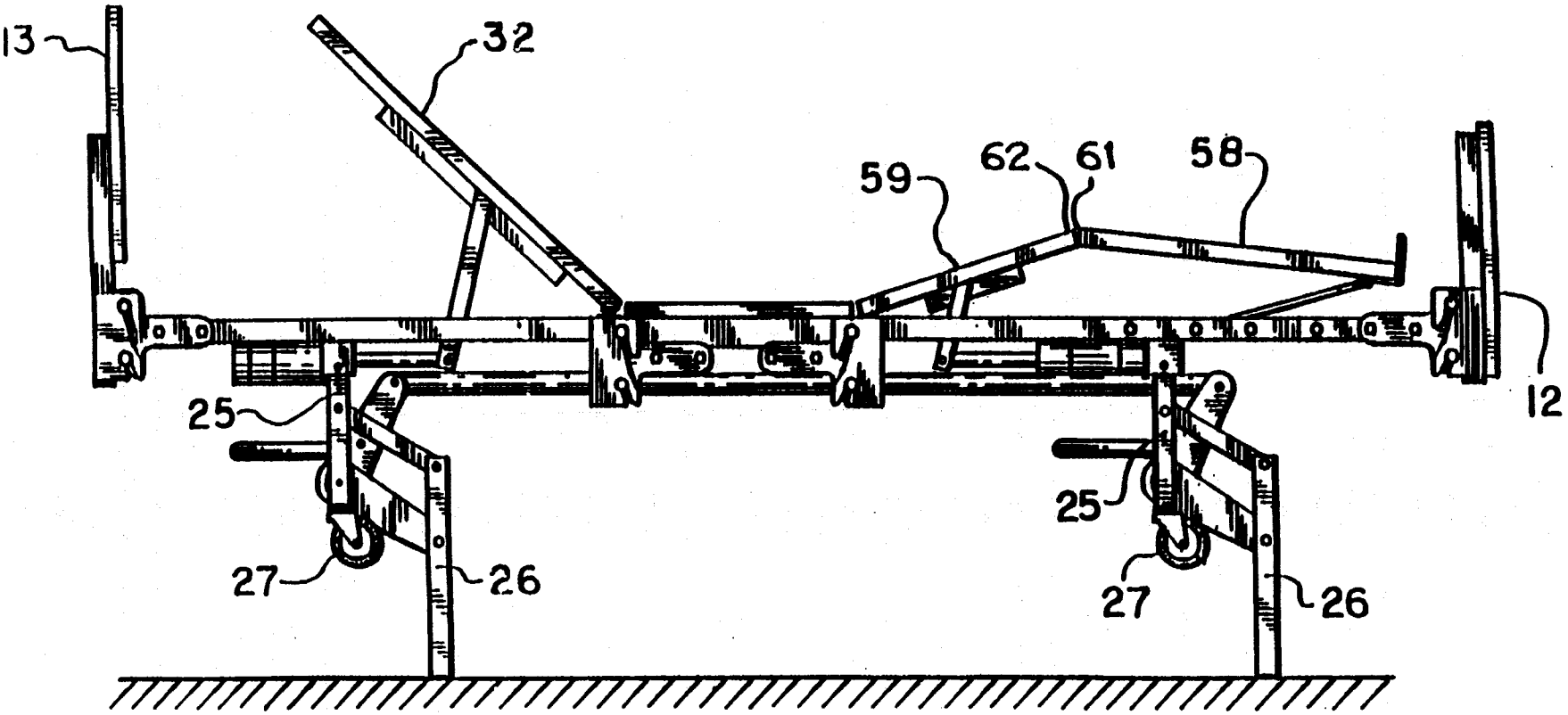
FIG. 10 is a diagrammatic side view illustrating the head and foot sections raised and the moveable legs extended.

Also mounted on the foot section frame 42 is an electric motor 55 driving one end of the linear jack 56. The other end of the jack 56 is pivotally attached to arms 57 fixedly mounted on a movably board 58 of the foot section. Actuation of the motor 55, and jack 56, moves board 58 and also board 59, boards 58 and 59 being pivotally connected at their adjacent edges 60 and 61. The edges 60 and 61 move upward, as illustrated in FIG. 10.

Figure 4:
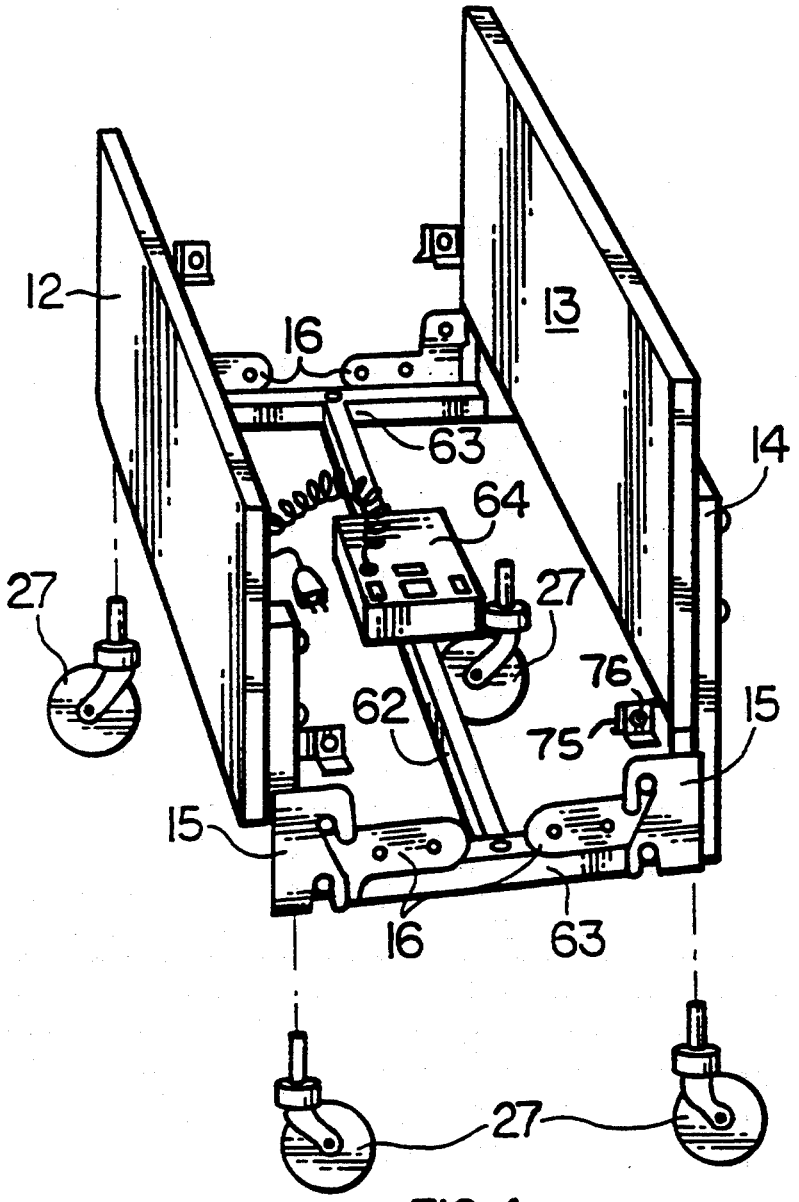
FIG. 4 is a perspective view on the upper side of the seat section with the head and foot boards, as unpacked.
Figure 5:
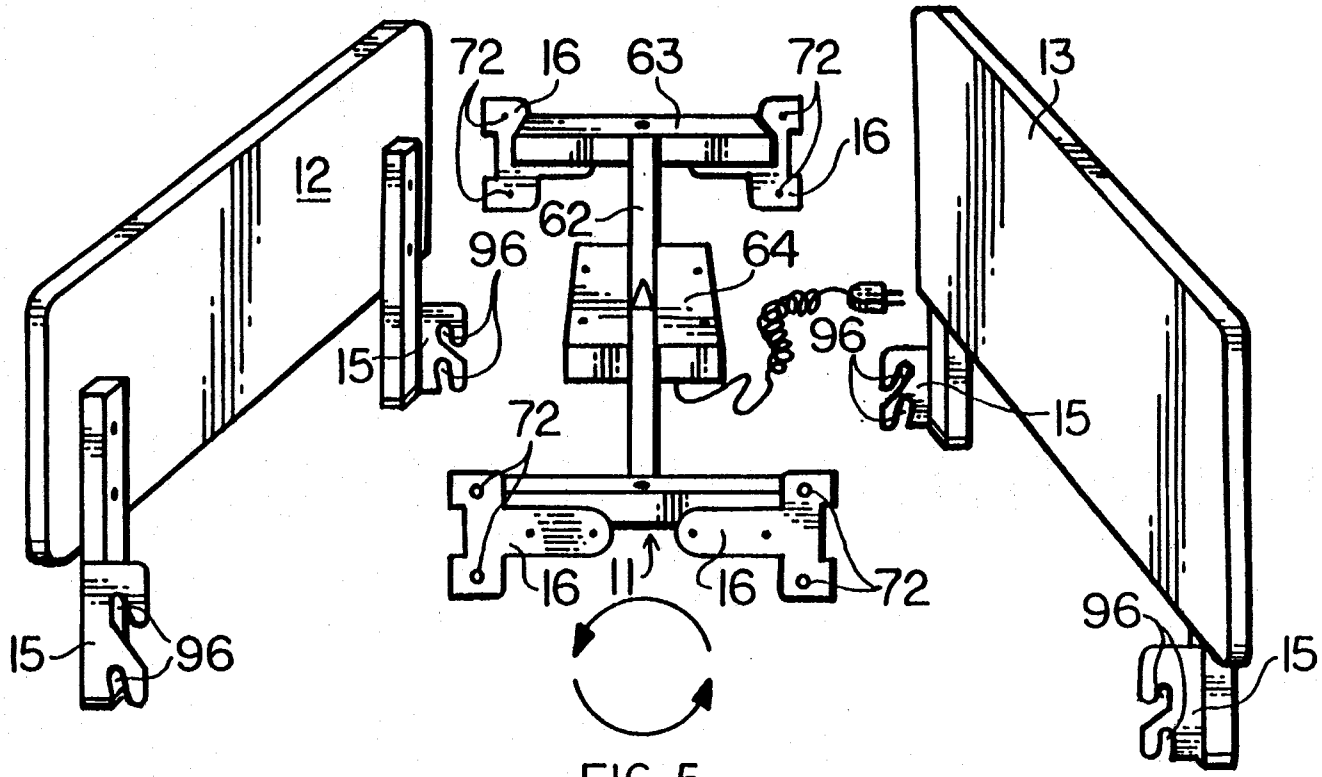
FIG. 5 is a perspective view similar to that of FIG. 4 showing the seat section separated from the head and foot boards.

FIGS. 4 and 5 illustrate the seat section 11, the seat board 14, head 13 and foot 12 boards attached in FIG. 4 with the head and foot boards shown detached and the seat section 11 turned over ready for assembly in FIG. 5. The seat section comprises a central transverse frame member 62 and side members 63.

Figure 6:
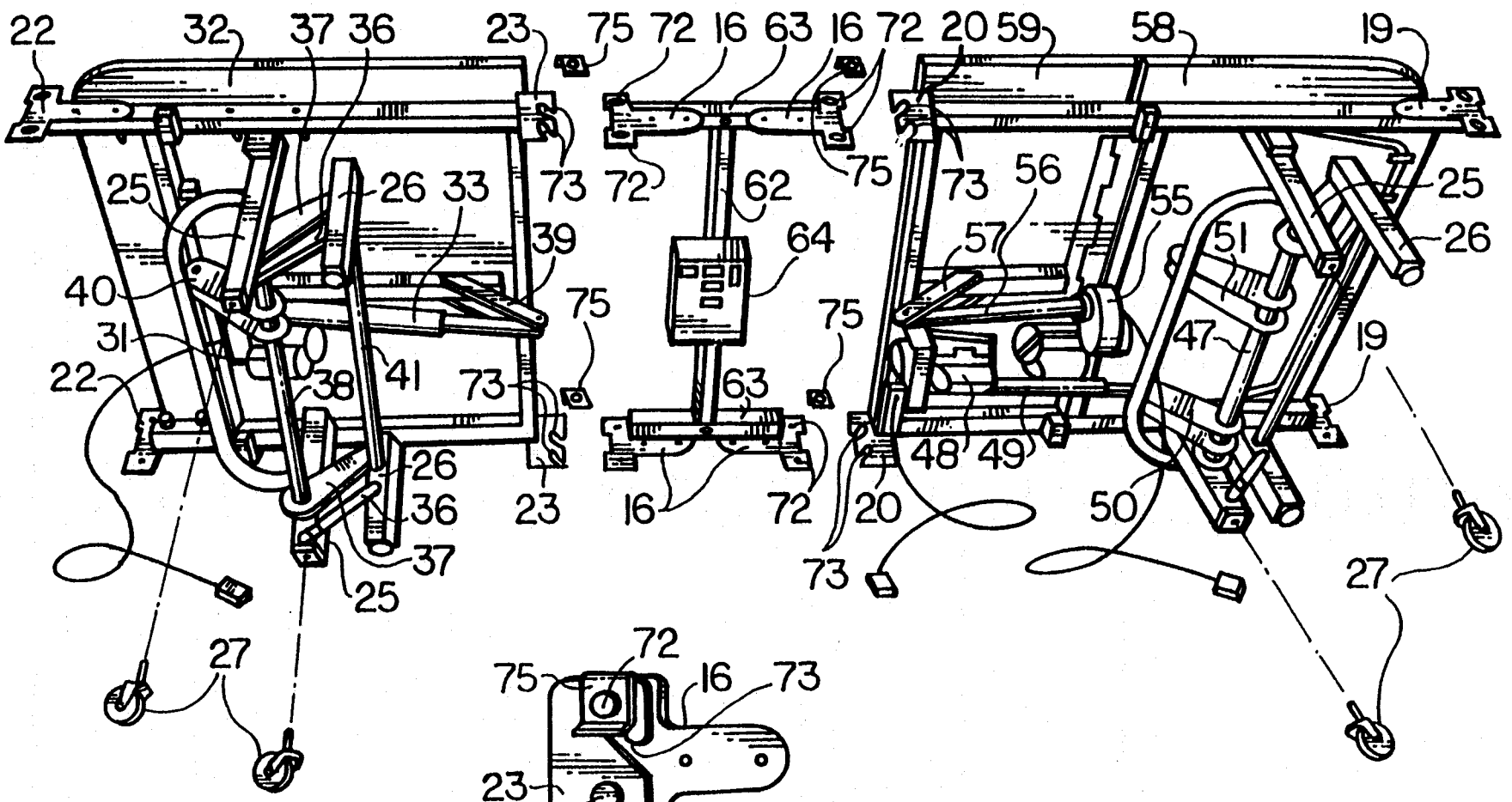
FIG. 6 is a perspective view on the underside of the head, seat and foot sections, positioned for assembly.

FIG. 6 illustrates the seat section 11 and the head section 21 and foot section 18 in juxtaposition ready for assembly. To assist in understanding the method of assembly, the arrangement of the various brackets 15, 16, 19, 20, 22 and 23 will be described, the brackets arranged to cooperate in pairs. The brackets of the head and foot boards, brackets 15, are adapted to clip onto the brackets 19 and 20 while the brackets 20 and 23 are intended to clip on to the brackets 16. Once such pairs of brackets 23 and 16 in engagement is shown enlarged in FIG. 6*a*.

Figure 6A:
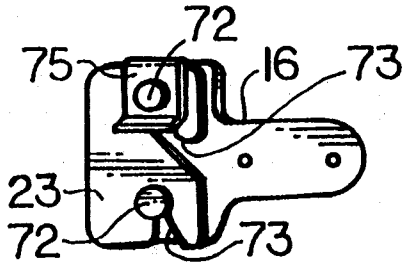
FIG. 6A is a perspective view of a connector bracket for removably securing bed components together.

As illustrated in FIGS. 6 and 6*a*, a pair of brackets 23, 16 for assembling sections together, comprises what can be termed a male bracket-bracket 16, which in the example is Tee-shaped, the leg 70 being attached, as by riveting, welding or other means to the outer end of a side member 63. The cross bar 71 of the bracket extends beyond the end of the side member and has two pins 72 extending laterally, relative to the bracket, and spaced vertically, for example on a vertical axis. What can be termed the female bracket, bracket 23, is in the form in the example, of a generally rectangular plate attached to the end of the head section. Bracket 23 extends in a vertical plane, as does also bracket 16. Two slots 73 extend up into the bracket 23, one from a bottom edge and one in from a free edge. The inner ends of the slots are spaced vertically for example on a vertical axis, and positioned so as to receive the pins 72. The head section is assembled to the seat section by inserting the pins in each bracket 16 at one edge of the seat section into the slot 73 in each bracket 23 on the head section. The brackets are pushed together until the pins are at the ends of the slots. To retain the brackets in an assembled condition, a clip 75 is positioned to embrace both brackets of a pair. The clip (see FIG. 4) is generally U-shaped and has a hole 76 in one arm to fit over a pin 72. This prevents the pins 72 moving in the slots 73.

A similar arrangement occurs for the bracket 16 and 20 for the assembly of foot section to the seat section. Once the three sections are assembled via the brackets 16 and 23 and 16 and 20, with the clips 75 in position, the assembly is rigid.

Figure 7:
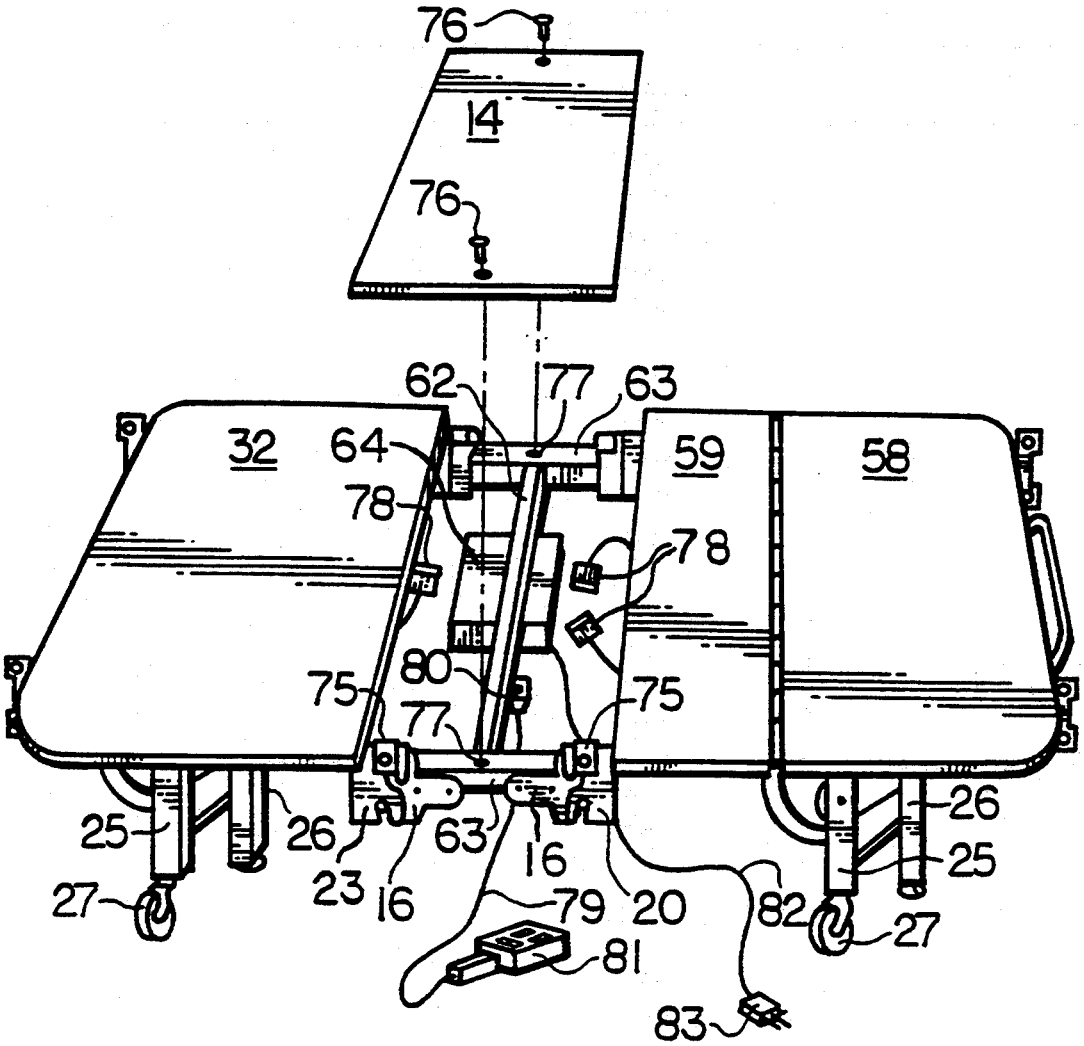
FIG. 7 is a perspective view on the upper side of the assembled head, seat and foot sections, with seat board shown.

FIG. 7 illustrates a bed substantially assembled. The head and foot sections are assembled to the seat section by the brackets 16 and 20 and 16 and 23. The seat board 14 is attached to the seat section by screw 76 passing through the seat board into fitted holes 77 in the side members 63. Electrical connectors 78, for the motors 31, 48 and 55 can be inserted into the connecting box 64. A flexible cord 79 is also connected at one end to the connecting box by a connector 80, with a control box 81 at the other end of the flexible cord 79. A power supply cord 82 has a connector 83 for connection to a power supply.

Figure 8:
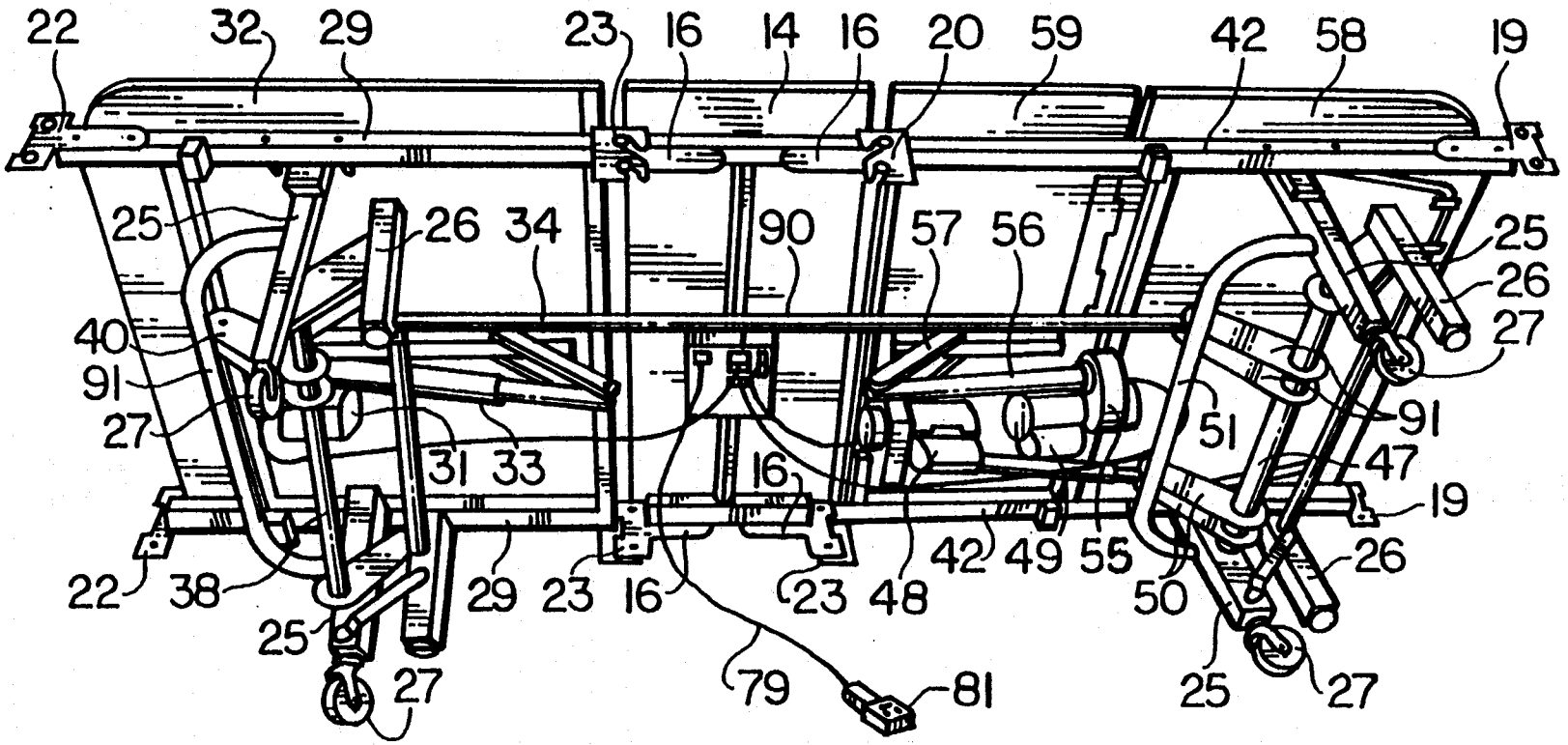
FIG. 8 is a perspective view on the underside of the assembled bed showing the various mechanisms for raising and lowering the head and foot sections and for extending and retracting the moveable legs.

FIG. 8 illustrates the assembled bed from below. The head, foot and seat sections are interconnected and a tube or other connecting member 90 is pivotally connected at each end to the levers 40 and levers 51. By this means, when shaft 47 is rotated by motor 48, jack 49 and levers 50, shaft 38 is also rotated. Rotation of the shafts 47 and 38 raises or lowers the movable legs 26, depending upon the direction of rotation of the motor 48. Also seen in FIG. 8 are the bars 91 which provide stability for the fixed legs 25.

Figure 9:
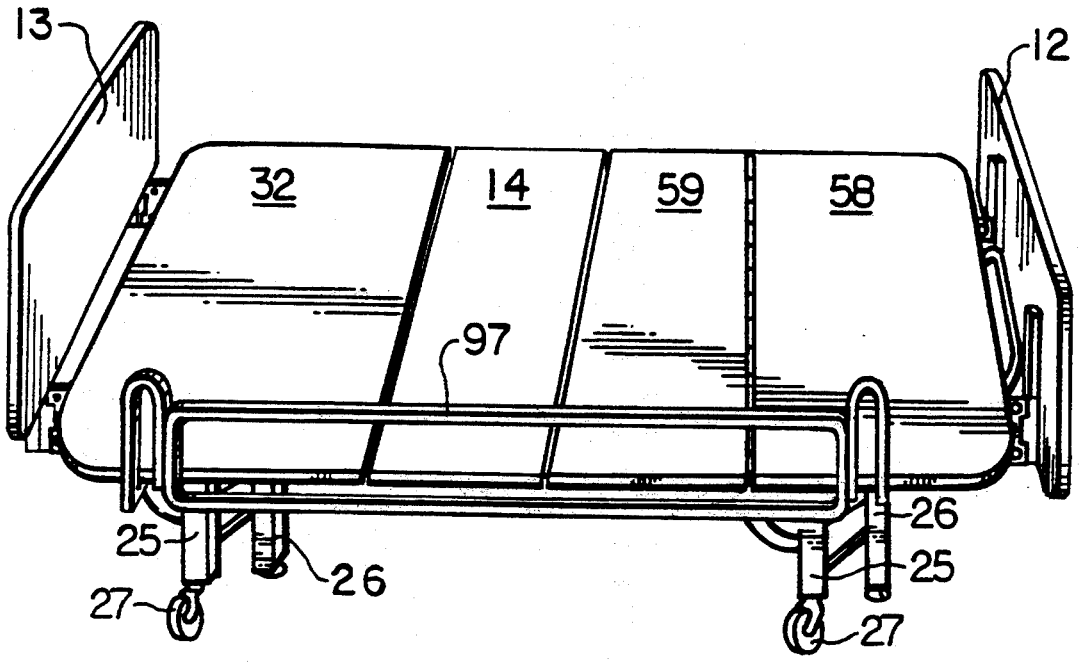
FIG. 9 is a perspective view on the upper side of the assembled bed, with head and foot boards attached.

FIG. 9 illustrates the assembled bed, from above, and also shows the head board 13 and foot board 12 in position. The head board is attached via the brackets 15, and brackets 19 and 22 respectively on the foot section and head section. The connection of the brackets is in the same manner as for the bed sections, pins 72 on the brackets 22 (FIG. 6*a*) fitting in slots 73 in the brackets 15. Clips of the same form as clips 75 can be used to prevent unwanted removal of the head and foot boards. Also shown in FIG. 9 are rails 97, in the example being formed square tubes welded to the frame members 29 and 42.

In FIG. 10 the head section board 33 is shown in a raised position and the foot section boards 58 and 59 are also shown in a raised position. It will be appreciated that only the head section board, or the foot section boards need be raised as desired. In FIG. 10 the movable legs 26 are shown in an extended position. This raises the bed with the wheels 27 off of the floor. This immobilizes the bed. The legs 26 can be retracted to bring the wheels 27 in contact with the floor if it is desired to move the bed.

Figure 11:
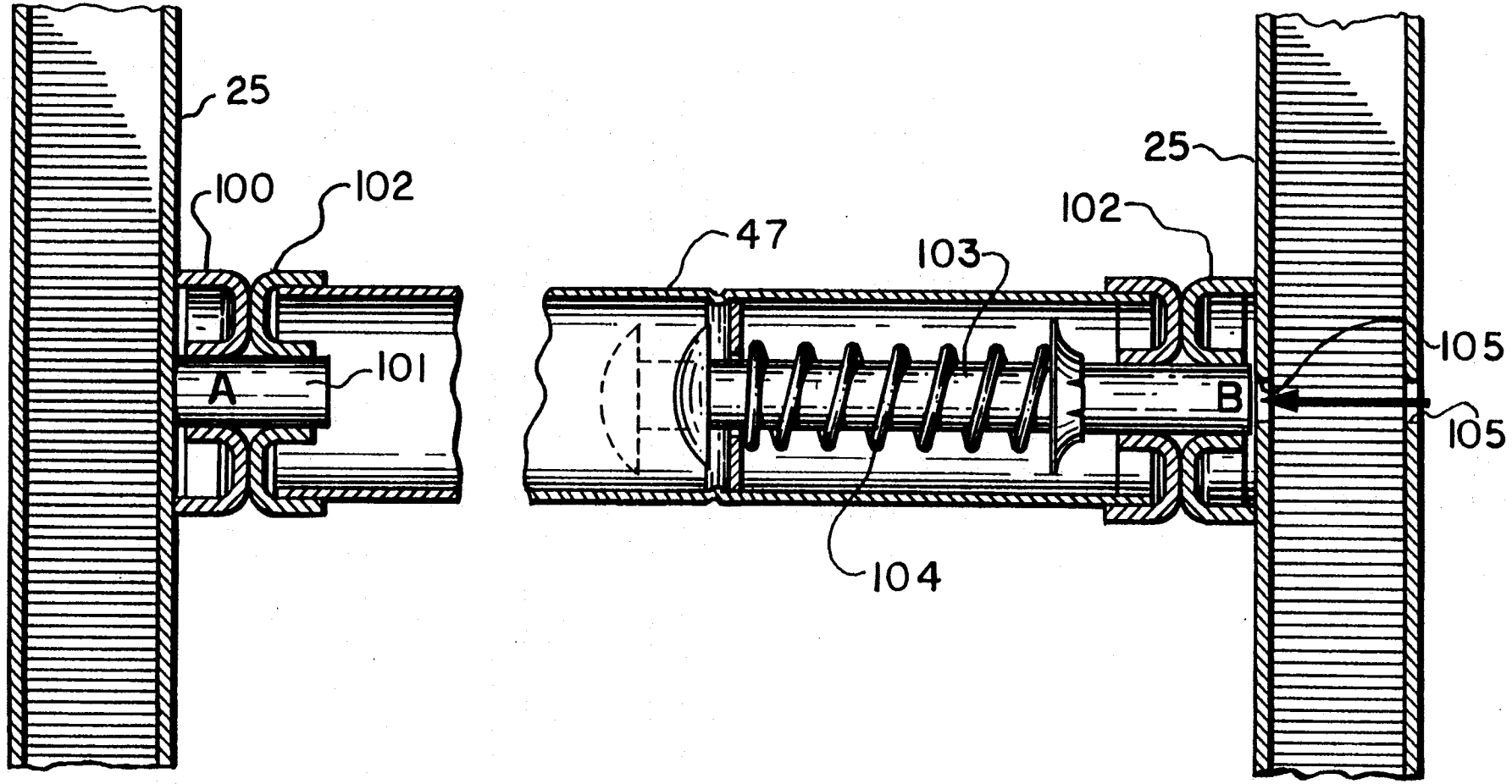
FIG. 11 is a cross section on the longitudinal axis of the main tube of the leg extending and retracting assembly, illustrating the means for removably mounting the assembly on the bed.

FIG. 11 illustrates a removable mounting arrangement for the movable legs 26, shaft 47, motor 48, jack 49 and levers 50 and 51 from the foot section. The shaft 47 is rotatably mounted at each end in support members 100 on the fixed legs 25. At one end a pin 101 which is fixed in the end 102 of the shaft 47, is mounted in one of the support members 100. At the other end a spring loaded retractable pin 103 is provided, slidable axially in the shaft 47, urged outwards by the spring 104. The pin 103 inserts into the other support member 100. Access to the end of the pin 103 is provided by the holes 105 in the fixed leg. The shaft and associated structure is assembled to the front section by first inserting pin 101 in its support member. Pin 103 is pushed in and the shaft end inserted at the other support member, and positioned so that the pin 103 moves into the other support member. The motor 48 is pivotally attached to the front section by a pin joined between a bracket 106 on the bed section and linear jack 49 on the motor 48 (FIG. 3). The arms 45 are also readily disengagable from the legs 25.

A similar mounting arrangement can be provided for the shaft 38, levers 37 and legs 26 on the head section. Thus, if desired, a bed can be supplied without the provision of movable legs and associated operating mechanism. This can be added later if desired.

The bed of the present invention provides various advantages. The motors are mounted adjacent to the particular member which is to be moved, eliminating drive members between the jack and the driven member or element.

The wheels can be mounted in two different positions, alternately for mobility in the packaged condition and for assembled bed mobility.

The bed breaks down into a number of basic pieces, for example five, for ease of storage and more compact packaging. These pieces, in the example described, are head board, head section, seat section, knee/foot section and foot board. No piece is very large or heavy which allows easy carrying upstairs to a bedroom.

The movable legs which move down, do not carry the wheels. Thus the bed is immobilized by moving the movable legs down, thus lifting the bed and also lifting the fixed legs, and wheels, up. This is different from previous beds where the movable legs carry wheels and are moved up to bring the fixed legs into contact with the floor. This immobilizes the bed in a lowered position, while with the bed of the present invention, the bed is immobilized in the up position, usually more convenient, especially for care personnel. Removable head and foot boards as illustrated in the drawings are necessary for the function of the said bed and therefore interchangeable with other boards of the owner's preference.

The bed is readily converted to one which does not have the elevating features, the raising and lowering mechanisms being easily removable and snapping into position if required.

The mattress deck, in the present example, that is head, foot and seat boards 14, 32, 58 and 59, are panels, having a wood core encapsulated in a fire rated synthetic resin. The resin surface can be texturized to help prevent the mattress from slipping. Wood core provides a stiffness while the encapsulation prevents moisture and bacteria absorption. As they are non-ferrous, the panels will not rust if scratched or otherwise damaged. Also, with metal panels, condensation can occur between mattress and panels. The present panels avoid this. In many conventional beds the mattress deck is metal framed with link fabric. This can tear the bedding or mattress and is in its complexity difficult to keep clean.

Various other differences occur. In the bed of the present invention, tubular structures and frames are used, as against angle cross-sections. This is lighter and is also easier to keep clean.

Figure 12:
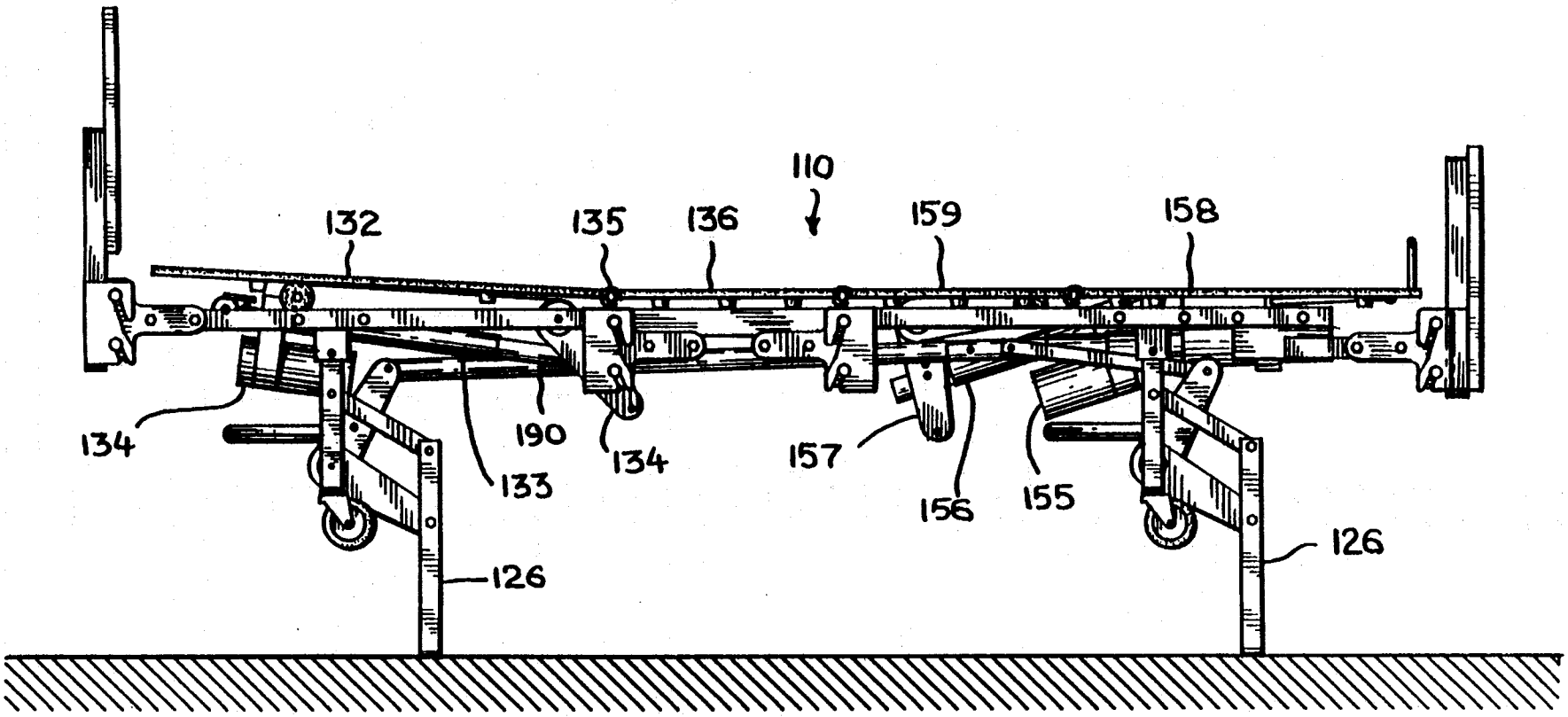
FIG. 12 is a side elevation of another embodiment of the bed of the invention.
Figure 13:
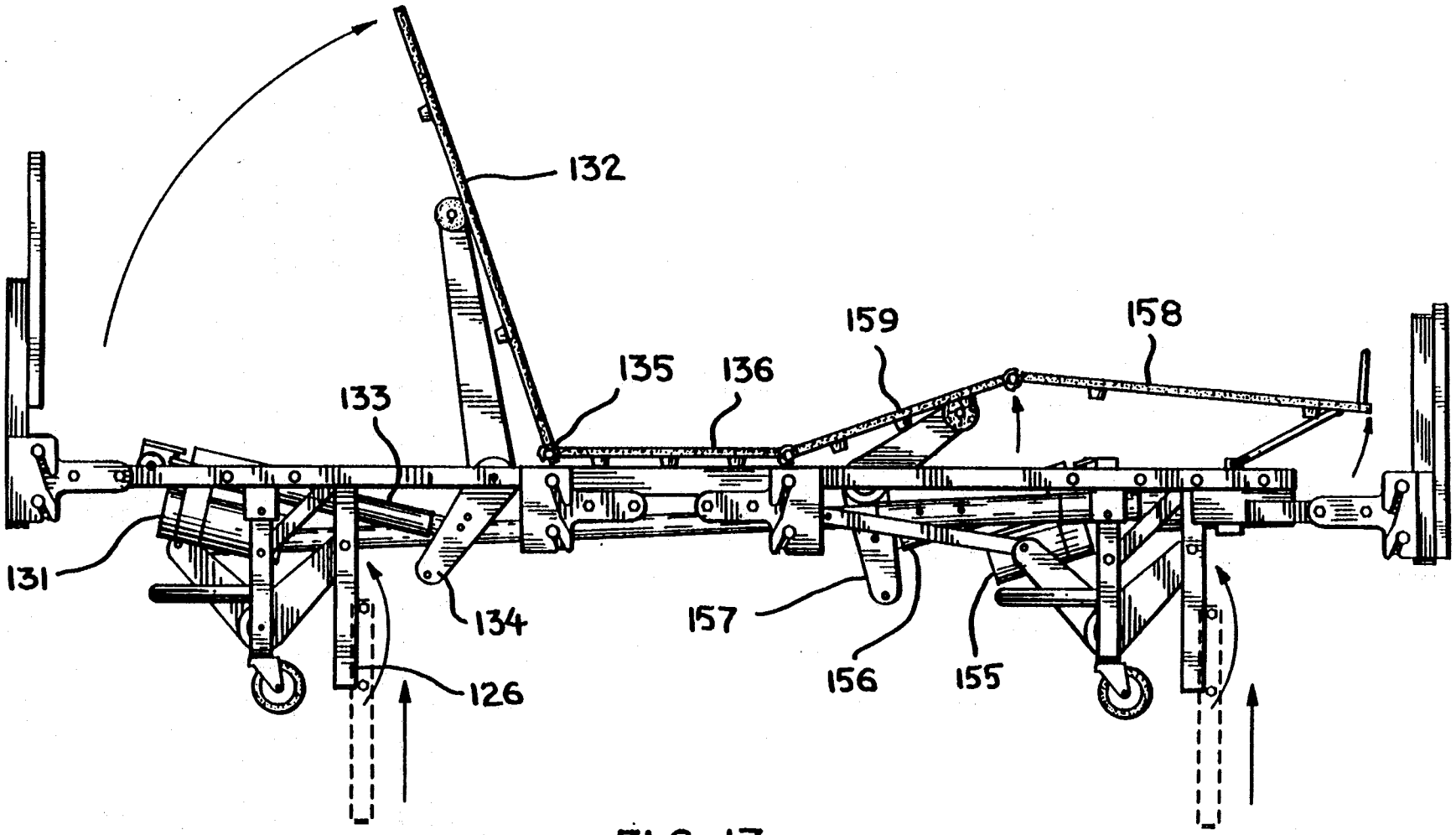
FIG. 13 is a side elevation of the embodiment illustrated in FIG. 12 showing the head and foot boards elevated and the legs retracted.

FIGS. 12 and 13 illustrate another embodiment of the bed of the invention in fully assembled positions. FIG. 12 illustrates the bed 110 having both pair of legs 126 extended by retraction of rod 190 to the right, as viewed in FIG. 12, in the manner described with reference to rod 90 shown in FIG. 8.

FIG. 13 illustrates upward retraction of both pairs of legs 126 and further illustrates upward pivotal movement of panel 132 of the upper body section and articulation of panels 158, 159 of the foot section. Actuation of motor 155 and linear drive 156 pivots bell crank 157 to pivot panel 159 and raise panel 158 articulated thereto, as will be described. Actuation of motor 131 and linear drive 133 pivots bell crank 134 to pivot panel 132 upwardly about joint 135 at the juncture with seat panel 136.

With reference now to FIGS. 14–23, FIGS. 20–23 illustrate the panels in their flat-lying position, each panel having a plurality of spaced-apart circular spacers 139 formed on the underside thereof at longitudinal reinforcing ribs 140 which form a reinforcing lattice with transverse reinforcing ribs 141. A down-turned shallow edge flange 152 is formed along the longitudinal edges of the panels and along the transverse edges thereof for reinforcement, the panels normally being formed from a rigid plastic such as by injection molding.

FIGS. 14–19 illustrate in detail hinge joint 135 which will now be described to typify the articulated joints of the invention. Each panel, e.g. panel 136, has at one end a transverse, generally cylindrical bar 145 spaced from transverse flange 142 and secured thereto by equispaced panel extension 146 defining narrow slots 147 therebetween. Bar 145 has a flat face 143 parallel to transverse flange 142 at slots 147 and has a diametrically opposed flat face 144 along the opposite side of bar 145.

The opposite end of each panel, e.g. panel 132, has a plurality of equispaced, arcuate extensions 148, 149 alternating from opposite sides of the panel edge flange 142 adapted to mate with and fit into slots 147 when adjacent panels are positioned perpendicular to each other as indicated more clearly in FIG. 15. Adjacent extensions 148, 149 are effectively opposed to each other and define a cylindrical recess 151 having a diameter substantially equal to the full diameter of transverse bar 145. The distal ends 152, 153 of extensions 148, 149 respectively are truncated to provide a gap width 154 (FIG. 19) substantially equal to the width 155 of bar 145 (FIG. 15) to allow opposed extensions 148, 149 to snugly fit over bar 145 when adjacent panels are fitted perpendicular to each other, as shown in FIG. 16.

Figure 17:
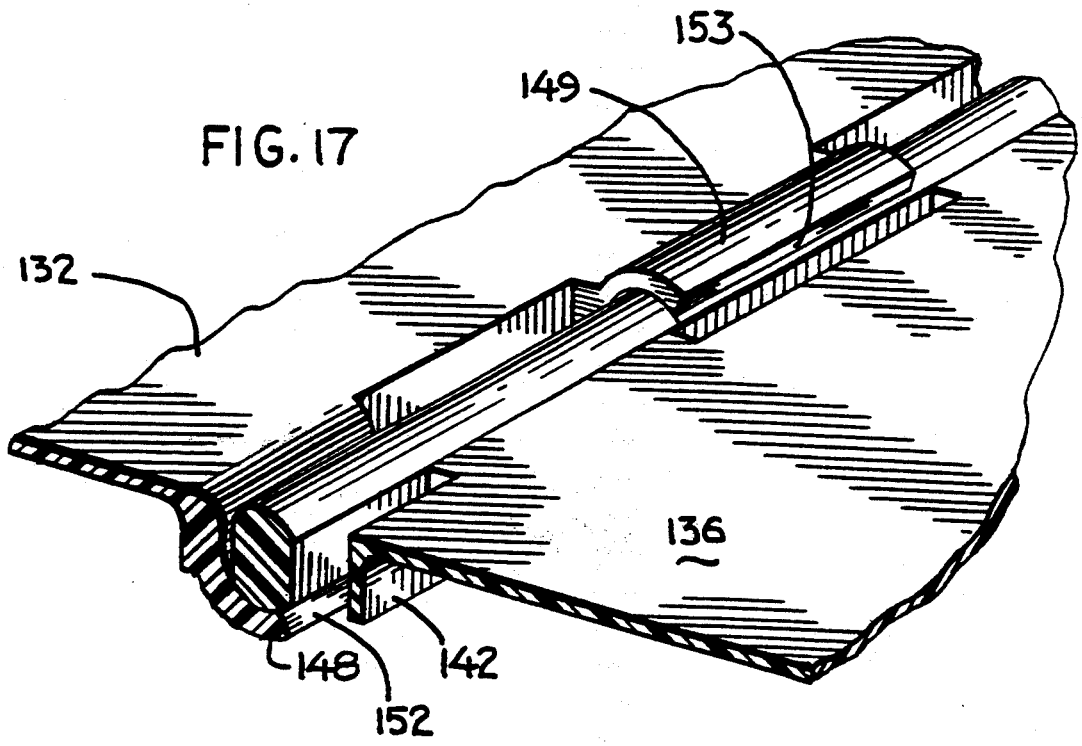
FIG. 17 is a perspective view of the hinge mechanism in a fully assembled position.
Figure 18:
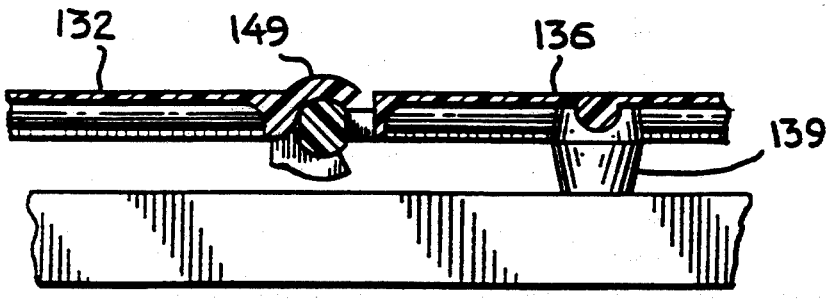
FIG. 18 is a longitudinal section of the hinge mechanism in its planar position shown in FIG. 17.
Figure 19:
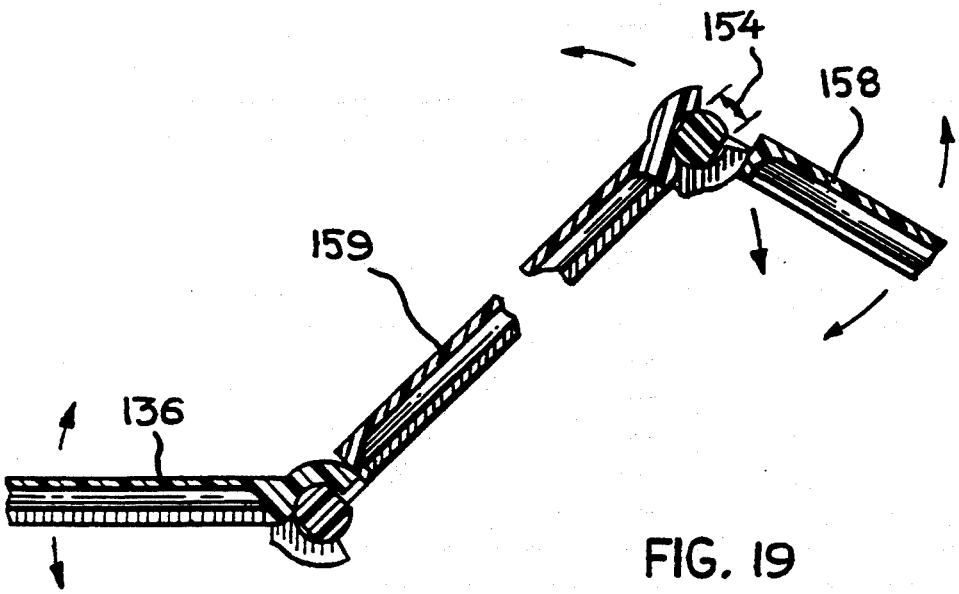
FIG. 19 is a longitudinal section of a panel assembly showing the said hinge mechanism in an articulated configuration.
Figure 20:
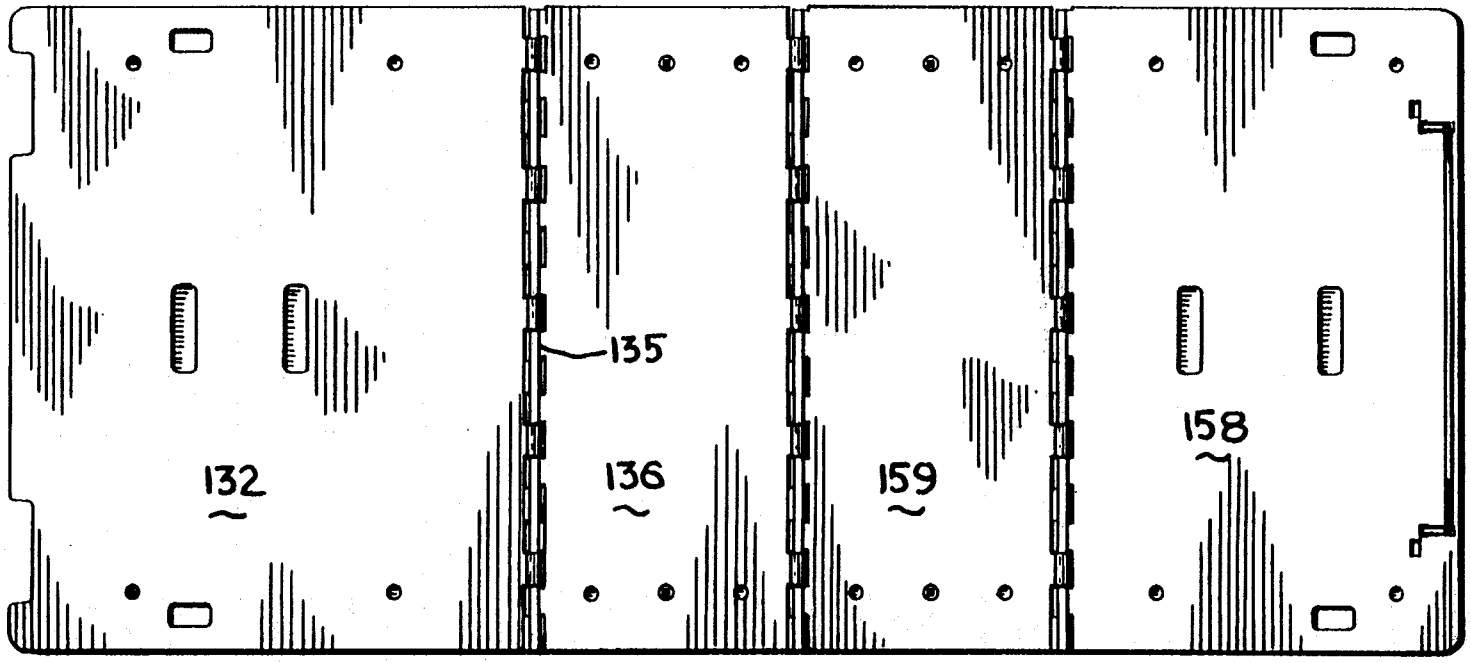
FIG. 20 is a plan view of the board assembly of the bed in a fully planar position.
Figure 21:
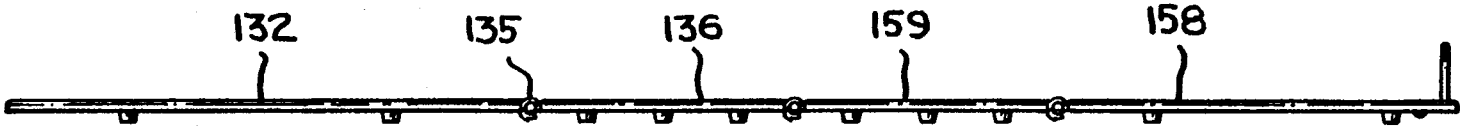
FIG. 21 is a side elevation of the board assembly shown in FIG. 20.
Figure 22:
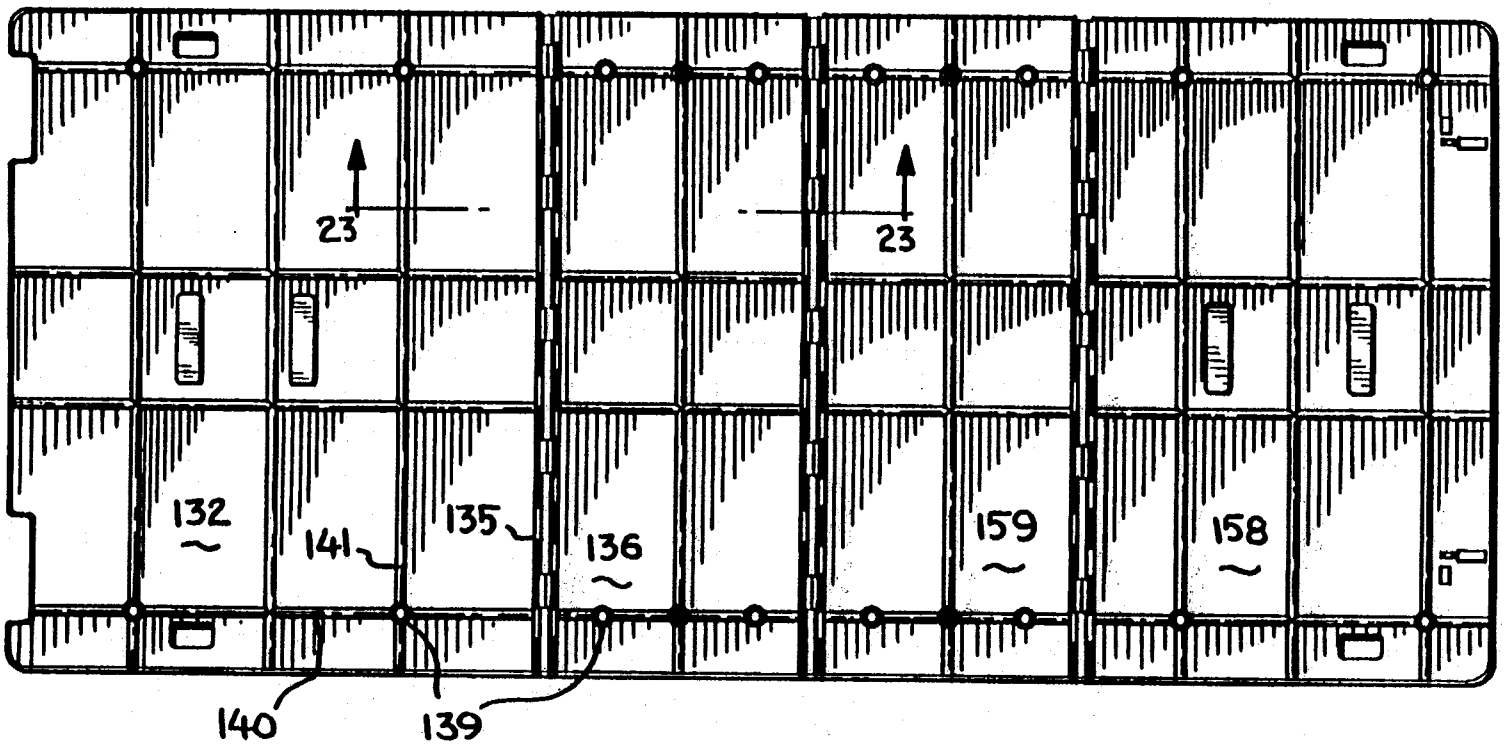
FIG. 22 is a plan view of the underside of the board assembly shown in FIG. 20.
Figure 23:
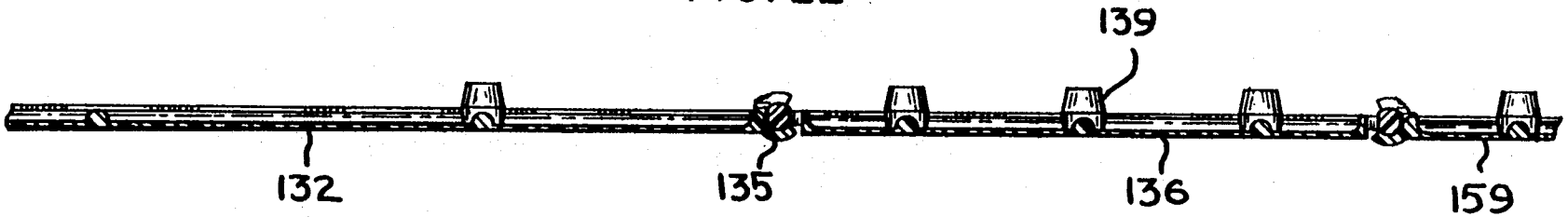
FIG. 23 is a longitudinal section, partly cut away, of the board assembly shown in FIG. 23.

Upon pivoting of one panel relative to another from a perpendicular position to an angle of less than 90°, the effective width of the bar 145 becomes the full diameter thereof, which is larger than the gap width 154 between the distal ends 148, 149 to lock the panels together as depicted in FIGS. 17–19, FIGS. 17 and 18 showing adjacent panels in a flat-lying position and seated on a supporting surface. FIG. 19 shows three connected panels corresponding to panels 136, 159 and 158 articulated essentially into the position shown in FIG. 13.

It will be understood that the hinge connection has utility for detachably joining panels together to form partition walls, shutters, curtains and doors. Overhead garage doors, for example, which can be opened and closed by motorized systems, can be readily assembled from a plurality of elongated panels incorporating the hinge system of the invention. Light-weight partition walls can be quickly and easily assembled into a variety of configurations.

The bed, in the packaged condition, is very compact and easily moved about. The packaged bed can be moved in the packaged condition, in a container, with the wheels projecting at the bottom. If it is desired, or necessary, to move the bed in sections, for weight or space reasons, it can be broken down into the separate sections and very quickly reassembled.

It will be understood, of course, that modifications can be made in the embodiment of the invention illustrated and described herein without departing from the scope and purview of the invention as defined by the appended claims.

I claim:

1. A knock-down bed separable into three frame components and a head board and a foot board for re-assembly into a packed bed for ease of storage and transport comprising:

a head section, a foot section and a seat section, each section including a frame;

means for releasably connecting said head section at an inner end to one end of said seat section and for releasably connecting said foot section at an inner end to the other end of said seat section;

a set of fixed support legs comprising a pair of legs mounted on the frames of each of said head and foot section;

a mattress deck comprising a head section panel at the inner end of the head section, a seat section panel overlying the seat section, and articulated foot section panels at the inner end of the foot section;

hinge means for pivotally interconnecting said head section panel, seat section panel and foot section panels, said hinge means comprising a generally cylindrical bar secured along an edge of an end of each panel by a plurality of equispaced panel extensions defining narrow slots therebetween proximate the panel edge, said bar having a flat face adjacent the edge at each slot and having a diametrically opposed flat face along the opposite side of the bar, and a plurality of equispaced, arcuate extensions alternating from opposite sides of an opposed end of another panel adapted to mate with and fit into the said slots, adjacent arcuate extensions effectively being opposed to each other and defining a gap therebetween substantially equal to the width of the bar at the diametrically opposed flat faces to allow the opposed extensions to snugly fit over the bar when adjacent panels are positioned at an angle of about 90° to each other and locking the panels together when the angle between the panels is less than about 90°;

means mounted on said head section frame for pivotally raising said head section panel;

means mounted on said foot section frame for pivotally raising said foot section panel;

a head board and a foot board and means for releasably mounting said head board and said foot board respectively at outer ends of the head section and the foot section; and wheels detachably mounted on bottom ends of said fixed legs, whereby upon knock-down of the bed into components the head board and the foot board are securable to the seat section to form a base for receiving the head section and the foot section.

2. A bed as claimed in claim 1, said means for releasably connecting said head section and said foot section to said seat section and said means for releasably mounting said head board and said foot board to the head section and the foot section comprising a plurality of pairs of cooperating brackets, one bracket of a pair having laterally extending projections and the other bracket of a pair having slots for receiving said projections.

3. A bed as claimed in claim 2, each pair of cooperating brackets including a clip extending over an edge of the pair of brackets and engaging with a projection to prevent movement of said projection in its slot.

4. A bed as claimed in claim 2, each pair of cooperating brackets comprising a first bracket and a cooperative bracket; a first bracket at each side of said head section at said inner end and a cooperative bracket at each side of said one end of said seat section; and a first bracket at each side of said foot section at said inner end and a cooperative bracket at each side of said other end of said seat section.

5. A bed as claimed in claim 4, said projections formed on one of said first bracket and said cooperative bracket of each pair and said slots formed in the other of said first bracket and said cooperative bracket of each pair.

6. A bed as claimed in claim 5, said projections comprising pins extending laterally, a clip extending over an edge of the pair of brackets, said clip comprising a U-shaped member having parallel legs, extending over each pair of brackets, at least one leg having a hole for engagement over a pin.

7. A bed as claimed in claim 1, said means for raising said head section board including an electric motor, a linear jack driven at one end by said motor and at least one arm pivotally attached at one end to the other end of said jack, said arm fixedly attached at its other end to said head section board, whereby on actuation of said motor of said head section board is caused to move up and down pivoting about an inner edge.

8. A bed as claimed in claim 7, said means for raising said foot section boards including an electric motor, a linear jack driven at one end by said motor, and at least one arm pivotally attached at one end to the other end of said jack, said arm fixedly attached at its upper end to one of said foot section boards, whereby an actuation of said motor said foot section boards are caused to move up and down at their adjacent edges, pivoting at their distal edges.

9. A bed as claimed in claim 8, including a connecting box mounted on said seat board, electrical connecting means for connecting said electric motors to said connecting box, and further electrical connecting means for connecting said electrical box to a power supply.

10. A bed as claimed in claim 9, including a control box connected to said connecting box for controlling said motors.

11. A bed as claimed in claim 1, further comprising; two sets of movable legs and means mounting a movable leg on each fixed leg; said means mounting each movable leg including an arm pivotally attached at one end to a fixed leg and pivotally attached at the other end to a movable leg; a first bell crank lever pivotally attached at one end to each movable leg a distance from said arm, said bell crank lever pivotally mounted at the other end on the fixed leg substantially parallel to the arm; a transverse shaft pivotally mounted between each said pair of fixed legs, a second bell crank lever extending from each transverse shaft substantially perpendicular to the first bell crank lever, an elongate connecting member pivotally connected to the second bell crank levers, and means for reciprocating said elongate member whereby said movable legs can be extended and retracted relative to the fixed legs.

12. A bed as claimed in claim 11, said means for reciprocating said elongate member comprising an electric motor mounted on said frame of one of said head section and said foot section, and a linear jack driven by said motor, said jack operatively connected to the elongate member.

13. A bed as claimed in claim 12, said elongate member and said shafts, said jack and said motor, removably mounted on the bed.

14. A bed as claimed in claim 12 including a connecting box mounted on said seat board, electrical connecting means for connecting said motor to said connecting box, and further electrical connecting means for connecting said connecting box to a power supply.

15. A bed as claimed in claim 14, including a control box connected to said connecting box for controlling said motor.

16. A bed as claimed in claim 1, said means for releasably mounting said head board and said foot board comprising a plurality of pairs of cooperating brackets, one bracket of a pair having laterally extending projections and the other bracket of a pair having slots receiving said projections.

17. A bed as claimed in claim 16, each pair of cooperating brackets including a clip extending over an edge of the pair of brackets and engaging with a projection, to prevent movement of the projection in its slot.

18. A bed as claimed in claim 17, each pair of cooperating brackets comprising a first bracket and a cooperative bracket; a first bracket at each side of said head section at an outer end and a cooperative bracket at each side of said head board, and a first bracket at each side of said foot section at an outer end and a cooperative bracket at each side of said foot board.

19. A bed as claimed in claim 18, said projections formed on one of said first bracket and said cooperative bracket of each pair and said slots formed in the outer of said first bracket and said cooperative bracket of each pair.

20. A bed as claimed in claim 19, said projections comprising pins extending laterally and said clip comprising a U-shaped member having parallel legs extending over each pair of brackets, at least one leg having a hole for engagement over a pin.

* * * * *